United States Patent [19]

Wexler

[11] Patent Number: 4,836,555

[45] Date of Patent: Jun. 6, 1989

[54] COMBINATION GLOVE AND SLAP BALL

[76] Inventor: Howard Wexler, 300 E. 40th St., New York, N.Y. 10016

[21] Appl. No.: 174,218

[22] Filed: Mar. 28, 1988

[51] Int. Cl.[4] ..... A63B 67/00

[52] U.S. Cl. ..... 273/330; 273/335; 273/414

[58] Field of Search ..... 273/330, 335, 412, 413, 273/414

[56] References Cited

U.S. PATENT DOCUMENTS

| | | | |
|---|---|---|---|
| 1,411,451 | 4/1922 | Mygind | 273/414 |
| 2,269,633 | 1/1942 | Merle | 273/330 |
| 3,153,537 | 10/1964 | Lewis | 273/412 |
| 3,229,979 | 1/1966 | Smoak, Jr. | 273/330 |
| 3,843,126 | 10/1974 | Bandy | 273/414 |

*Primary Examiner*—William H. Grieb

*Attorney, Agent, or Firm*—Peter L. Berger

[57] ABSTRACT

A combination of a glove worn by a user and a ball and stretchable member removably attached to the glove is disclosed. The ball is permanently attached to one end of the stretchable member, and the other end is attached to an anchor which is removably attached to the palm of the glove, so that the user can slap the ball and be assured of its return. The stretchable member is adjustable in size and the ball may be of any desired size and structure. Additionally, the glove may be worn on either hand.

12 Claims, 4 Drawing Sheets

COMBINATION GLOVE AND SLAP BALL

BACKGROUND OF THE INVENTION

This invention relates to a novel glove and ball structure which resembles a paddle and ball structure. The ball is fixedly attached to the paddle by a stretchable member and returns to the paddle after it is hit by the user.

The present invention eliminates the need for a paddle and provides a glove-like member to be worn by the user to which the stretchable member or a rubber band and ball is detachably secured. The ball is fixedly attached to one end of the rubber band and is fixedly attached at its other end to a disk member. A pocket is formed in the palm of the glove, which receives and holds the disk to attach the rubber band/ball combination to the glove, allowing the ball to return to the user's hand after it is slapped. The length of the stretchable member can be adjusted, and the glove member may have a padded palm to prevent injury to the user. The glove member is constructed so that it can be worn on either hand.

An object of this invention is to provide an improved novelty toy structure which will find widespread use.

Another object is to provide such a device which is safe to use, can be used by people of different skills and ages and is portable.

Yet another object of this invention is to provide such a novelty toy which includes a glove structure that can be worn on either hand, is attractive and will lend itself to large commercial success.

Still another object of this invention is to provide a glove and ball combination in which the balls are interchangeable for use with the glove.

Other objects, advantages and features of this invention will become more apparent from the following description.

SUMMARY OF THE INVENTION

In accordance with the principles of this invention, the above objects are achieved by providing, in combination, a glove member to be worn on the hand, a stretchable member having one end fixedly attached to a ball and the other removably attached to the glove, enabling the user to slap the ball with the palm of the hand ensuring that the ball will return. The ball structure and size can be chosen to suit different needs, so that a soft structure may be more suitable for young children, while a harder structure may be more suitable to adults.

The length of the stretchable member, which could be a rubber band or similar band, is adjusted by rotation around an anchor disk fixedly attached to the end of the stretchable member, the disk serving as an anchor which is removably attached to the palm portion of the glove member. In this manner, the glove can be interchangeably used with different ball structures and/or for different band lengths. Additionally, the glove is formed of finger segments and a thumb member allowing it to be worn on either hand with the pocket located in the palm of the hand.

BRIEF DESCRIPTION OF THE DRAWINGS

FIG. 2 is a front view of another embodiment of the

DETAILED DESCRIPTION

The glove 10 is formed of a front surface 12. The front surface has a palm section 14 which may be padded and includes a pocket 16. The glove is formed of an attractive construction of a four finger and thumb model with these structures partially cut away.

Figure 1:
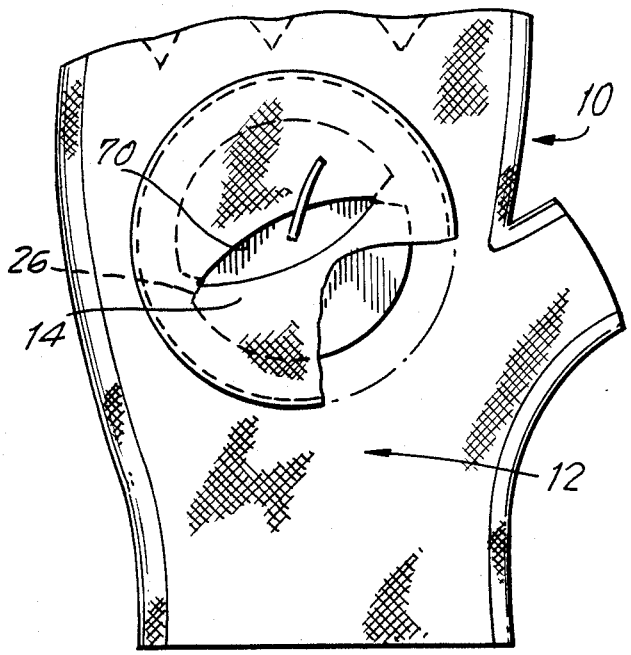
FIG. 1 is a front view of the glove.
Figure 2:
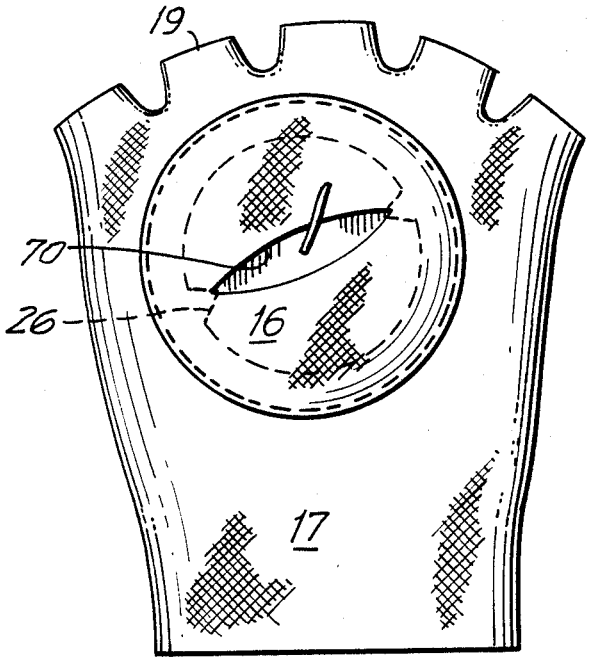

FIG. 2 illustrates an alternative embodiment 17 in which the finger structure allows the glove to be worn on either hand. The glove is preferably made of stretchable material to easily conform to the shape of the hand on which the glove is worn. All the finger segments 19 are of substantially equal length.

Figure 3:
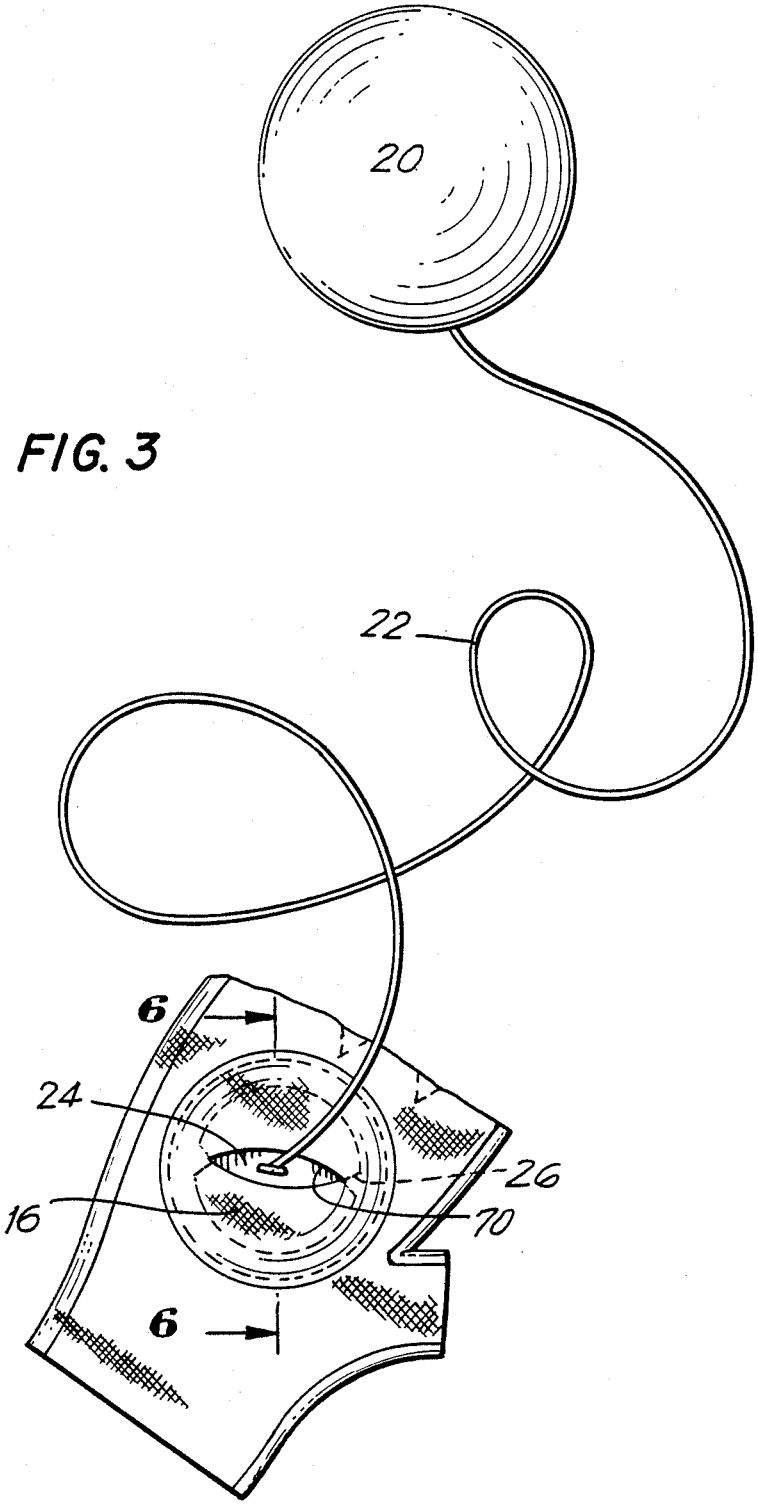
FIG. 3 is a perspective view showing the glove and ball combination of this invention.
Figure 7:
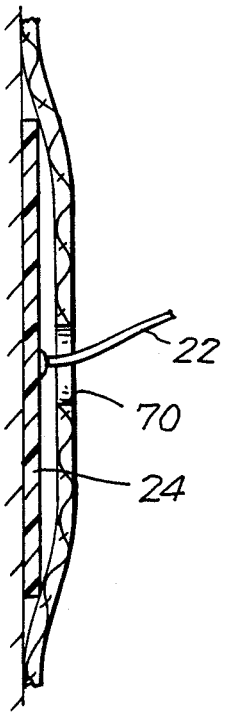
FIG. 7 is a cross-section of an alternative embodiment similar to FIG. 6 in which the disk is slipped in the slot in the palm of the glove to rest between the palm and front of the glove.

A ball 20 is illustrated in FIG. 3 which is attached permanently to one end of a stretchable member or rubber band 22, the other end of which is fixedly connected to a disk anchor 24. A pair of notches 26 are formed on opposites sides of the periphery of the anchor, and the stretchable member is wound around the disk through the notches to adjust its length. In use, the anchor 24 is placed within the pocket 16 in the palm of the glove, and the anchor sits in pocket 16. The user slaps the ball 20, and it will return to the user's hand because of the attachment of the stretchable member to the glove. An alternative embodiment as in FIG. 7 would substitute a slot 70 in the palm of the glove through which the disk 24 is inserted to be captured in the glove during use.

The length of the stretchable member may be adjusted, which will enable it to be adapted to be used by people of different skills and ages, such that a young person might choose a shorter band, while an older or more skilled person might choose to work with a longer stretchable band. The balls are interchangeable so that a purchaser need only buy a single glove structure which can be used with different ball/band combinations.

The ball may be as soft or hard as desired and its size can be selected to work well with this invention. One advantage of this invention is that the glove may be used with different balls and can be worn on either hand.

Figure 4:
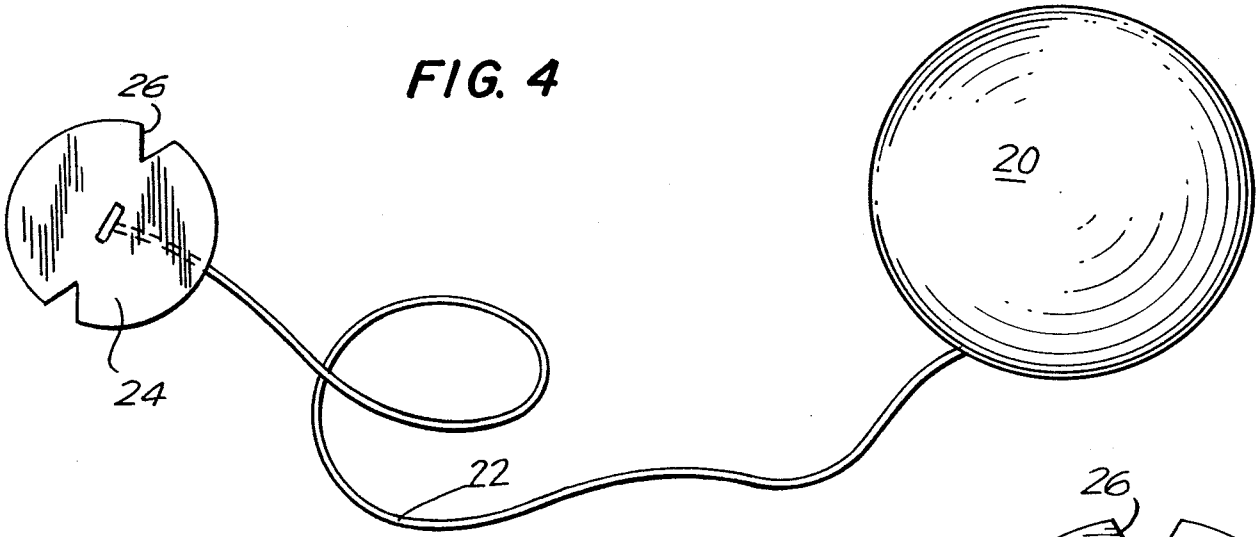
FIG. 4 is a detail showing the disk and rubber band adjustable structure.
Figure 5:
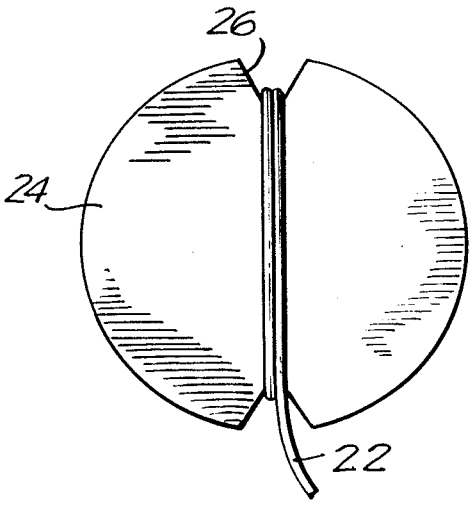
FIG. 5 is a detail of the disk with the rubber band wound therearound.
Figure 6:
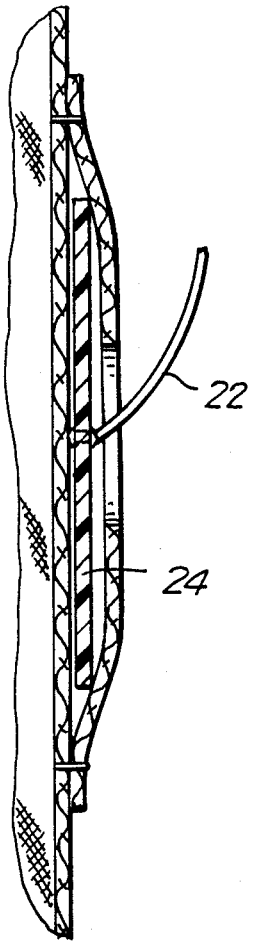
FIG. 6 is a cross-section taken along line 6—6 of FIG. 3 showing the pocket of the glove holding the disk.

FIGS. 4 and 5 show the rubber band 22 wound around the disk 24 through notches 26.

This invention has been described with regard to a preferred embodiment, and other modifications of this invention may be made without departing from the spirit and scope of the invention as set forth in the appended claims.

What is claimed is:

1. In combination, a glove to be worn on the hand, a ball, a stretchable member having two ends, one end fixedly attached to the ball and the other end fixedly attached to an anchor member, said glove comprising slot means to removably attach said anchor member to said glove in said slot means to permit said stretchable member and ball to be separated from said glove and also to permit said ball to be elastically attached to said glove, whereby the user can slap the ball repeatedly assured it will return to the gloved hand.

2. A combination as claimed in claim 1, wherein said glove comprises a pocket in the palm thereof, said anchor member comprising a disk which slips into said pocket, said anchor member being held in said pocket against the palm of the hand of the user during use.

3. A combination as claimed in claim 1, wherein said palm of said glove is padded.

4. A combination as claimed in claim 2, wherein said palm of said glove is padded.

5. A combination as claimed in claim 4, wherein the length of said stretchable member is adjustable.

6. A combination as claimed in claim 5, wherein said stretchable member is wound around said disk to adjust its length.

7. A combination as claimed in claim 6, wherein said disk comprises a pair of notches oppositely disposed on the periphery thereof to set the adjustable length at a desired length.

8. A combination as claimed in claim 7, wherein said finger and thumb segments are of substantially equal length permitting the glove to be worn on either hand.

9. A combination as claimed in claim 8, wherein the glove comprises a stretchable material.

10. A combination as claimed in claim 1, wherein said glove may be worn on either hand.

11. A combination as claimed in claim 2, wherein said glove may be worn on either hand.

12. A combination as claimed in claim 3, wherein said glove may be worn on either hand.

* * * * *